US008505125B1

(12) United States Patent
Chia et al.

(10) Patent No.: US 8,505,125 B1
(45) Date of Patent: Aug. 13, 2013

(54) HAIR CATCHING STALL SHOWER DRAIN

(75) Inventors: Stacy Leanne Chia, Irvine, CA (US); Peter Jun Chia, Irvine, CA (US)

(73) Assignee: Stacy Chia, Irvine, CA (US)

( * ) Notice: Subject to any disclaimer, the term of this patent is extended or adjusted under 35 U.S.C. 154(b) by 266 days.

(21) Appl. No.: 12/798,672

(22) Filed: Apr. 9, 2010

(51) Int. Cl.
*E03C 1/26* (2006.01)

(52) U.S. Cl.
USPC ..... 4/289; 4/290; 4/292

(58) Field of Classification Search
USPC ..... 4/286–290, 292, 507, 679–681, 688, 4/650–652, 612
See application file for complete search history.

(56) References Cited

U.S. PATENT DOCUMENTS 137,788 A * 4/1873 Moore ..... 4/668
197,543 A * 11/1877 Carnes ..... 4/688
212,614 A * 2/1879 Magee ..... 4/289
664,945 A * 1/1901 Guion ..... 4/652
774,201 A * 11/1904 Robischon ..... 4/289
1,756,290 A * 4/1930 Hibner ..... 4/289
RE31,561 E * 4/1984 Thompson ..... 4/290

* cited by examiner

*Primary Examiner* — Huyen Le
*Assistant Examiner* — Erin Deery
(74) *Attorney, Agent, or Firm* — KPPB LLC

(57) ABSTRACT

A drain strainer with an upper drain plate with large holes and a lower basket with small holes allows particulate matter to fall through the large holes but not enter the small holes. This two-story feature allows the drain strainer to have a flush, aesthetically pleasing appearance, and also prevents particulate matter from sitting on top of the drain, which could sully the feet of a shower user or could float to other parts of the tub or sink. The upper drain plate could be attached via a recessed hinge with a finger hole that allows a user to easily access the basket without the use of tools.

14 Claims, 9 Drawing Sheets

HAIR CATCHING STALL SHOWER DRAIN

FIELD OF THE INVENTION

The field of the invention is drain strainers.

CROSS REFERENCES

| | | |
|---|---|---|
| D256,948 | September 1980 | Boersma |
| D348,924 | July 1994 | Merrett |
| 1,593,087 | July 1926 | Logan |
| 1,950,817 | March 1934 | Rossman |
| 2,668,962 | February 1954 | Spector |
| 3,027,569 | April 1962 | Lantz et al. |
| 3,525,105 | August 1970 | Richards |
| 6,163,896 | December 2000 | Lee |

BACKGROUND

Most drains do not adequately filter out foreign matter, such as hair or large food particles, that could build up in the drainage pipe over time. These clogs could lead to slow or even stopped drains, which greatly inconvenience today's busy consumer. Harsh chemicals used to dissolve or otherwise clear the clog put the consumer at risk for chemical burns, and could harm portions of the drainage pipe. In addition, such chemicals are sometimes ineffective, requiring an expensive plumbing professional to be hired.

U.S. Pat. Nos. 1,593,087, 1,950,817, 2,668,962, 3,027,569, and 3525105 teach drain strainers that are designed to fit over or within the opening of a drain to prevent foreign matter from clogging the drain. These cupped strainers are rather ugly to behold and pose a danger to shower users who tend to ambulate around the hole area. These and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

U.S. Pat. No. 6,163,896, D348924 and D256948 teach a drain covers that are substantially flush with the floor of a shower or a tub, but foreign matter tends to collect on top of these drain covers, ruining the aesthetics of the drain.

Thus, there is still a need for improved drain straining systems.

SUMMARY OF THE INVENTION

The inventive subject matter provides apparatus, systems, and methods, in which a drain strainer prevents foreign particulate matter from entering a drain using a basket with a plurality of basket holes, and also provides a flush appearance by providing a drain plate over the basket.

Generally, the basket rests within the mouth of the drain, and has one or more basket holes that allow water to pass through into the drain while preventing particulate matter from entering the drain. Such particulate matter typically comes in the form of hair in the shower, or food bits in a kitchen sink. Preferably, the basket is at least 1, 2, or even 3 cm deep into the drain so that basket holes could be located on the side walls of the basket as well, increasing liquid throughput into the drain even if the bottom of the basket becomes clogged.

The basket could be shaped in any suitable manner, for example cylindrical or rectangular. Preferably, the base is substantially ovoid, or at least has rounded edges to prevent particulate matter from being trapped in the corners of the basket, although substantially rectangular bases are contemplated for ease of manufacturing. As used herein, a "substantially ovoid" or a "substantially rectangular" base is one that may have additional corners or rounded edges, respectively, without departing from the scope of the current invention.

The basket is preferably covered with a drain plate with one or more large drain holes that allow most particulate matter to fall into the basket. The large holes in the cover plate allow particulate matter to fall through the cover plate to be hidden from view while the small holes in the basket prevent the particulate matter from entering the drain. While all of the holes in the drain plate are preferably larger than each of the basket holes, some of the drain plate holes could be shaped with a smaller diameter or width than a basket hole without departing from the scope of the invention. Preferably, the drain plate covers the entire perimeter of the upper opening of the basket, although the drain plate could be designed to cover only a portion of the upper opening's perimeter without departing from the scope of the invention.

Preferably, the total "area" of the drain holes is smaller than the total "area" of the basket holes, so that the liquid throughput of the basket is greater than the liquid throughput of the drain holes, preventing the liquid from pooling in the basket unless the basket becomes severely clogged. In any event, the holes should be sized and dimensioned such that the liquid throughput of the basket is at least as great as the liquid throughput of the drain plate to prevent such a bottleneck.

While the edge of the drain plate could be slightly recessed to give a user leverage to pry the drain plate off of the basket, a finger-sized hole is preferably formed in the drain plate to allow a user to remove the drain plate from the basket without the use of tools. The hole could be located in the center or on a side of the drain plate, and a plurality of holes could be created to allow multiple digits to be used. Preferably, the hole has a width of at least 0.5, 1, 1.5, or even 2 cm, depending on the size of the drain hole and the estimated size of the user.

The drain plate preferably sits in a recess to hole it in place over the basket. This recess is preferably formed by an outer ring coupled to the basket. The outer ring preferably has a hole that is larger than the opening of the basket, and is sized and dimensioned to receive the drain plate, such that the juxtaposition of the outer ring and the upper opening of the basket forms a recess that receives the drain plate. While the outer ring is preferably a separate component that is welded to or otherwise attached to the basket, the outer ring and the basket could be molded as one unit without departing from the scope of the invention. Where the outer ring and the basket are molded from separate components, the components are preferably attached to one another using a permanent adhesive that prevents the components from separating, although interlocking connections are also contemplated. The outer ring also preferably has at least two opposing screw holes that allow the drain strainer to be attached to any standard drain.

In an exemplary embodiment, the drain plate is hingedly connected so that a user could flip open the drain plate at any time to remove particulate matter that has been caught by the basket. This hinge could be located on the basket, the outer ring, or any other plumbing piece that is attached to the upper opening of the basket. Preferably the axle of the hinge rests below the surface of the outer ring, so that the hinge does not project from the surface of the drain strainer. This allows the drain plate to appear flush with the outer ring, reducing the number of jagged edges that may catch a user's foot in a shower, for example.

In a preferred embodiment, a plurality of drain plates could be designed to mate with a single outer ring. For example, a first drain plate could have substantially linear holes surrounding a central finger hole, while a second drain plate could have smattering of large and small holes that are chaotically distributed across the surface. Other drain plates with designs or color are also contemplated. Such interchangeable drain plates could provide a plethora of different aesthetic designs for a common basket and outer ring.

Various objects, features, aspects and advantages of the inventive subject matter will become more apparent from the following detailed description of preferred embodiments, along with the accompanying drawing figures in which like numerals represent like components.

BRIEF DESCRIPTION

DETAILED DESCRIPTION

Figure 1:
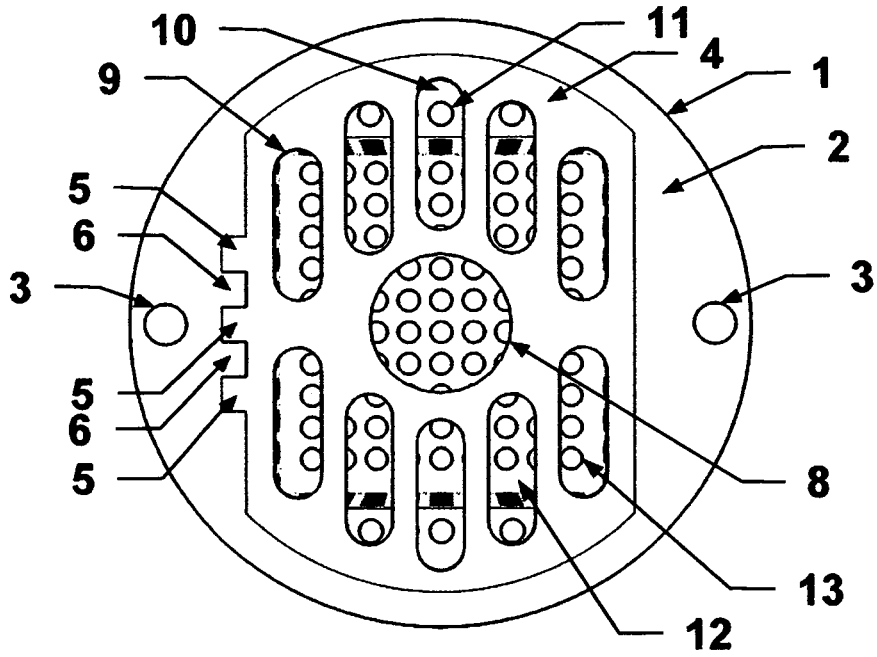
FIG. 1 is a top plan view of an embodiment of the invention, showing a closed lid and a drain basket.

FIGS. 1-9 show different views of drain 1, with an outer ring 2, drain plate 4, and basket 12. While outer ring 2 and basket 12 are shown as separate components that are permanently attached, the outer ring and basket could be molded from a single piece without departing from the scope of the invention. Outer ring 2 has screw holes 3 in outer ring 2 that are sized and dimensioned to fit a standard shower drain used in the United States, and could be threaded to improve the connection between the screw and the outer ring. Outer ring 2 preferably sits within a recessed ledge (not shown) so that the top surface of the outer ring is substantially flush with the surface of the shower floor when installed. As used herein, surfaces that are "substantially flush" with one another have a height differential of at most 1 mm.

Figure 2:
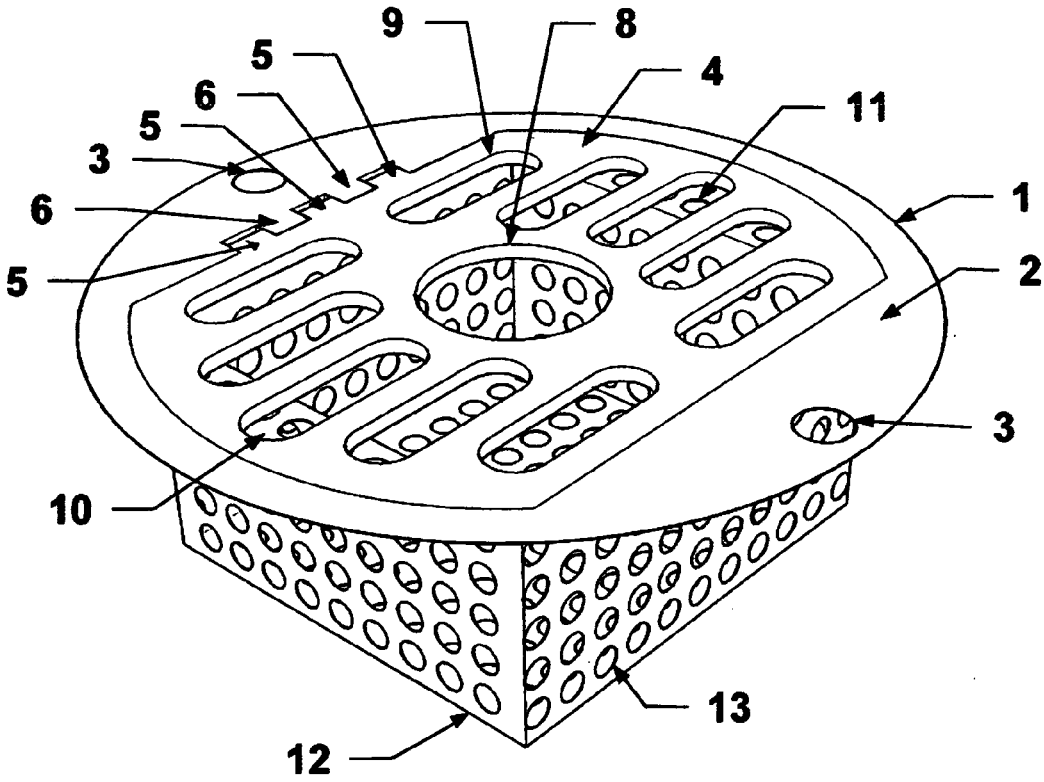
FIG. 2 is a perspective view of the drain strainer of FIG. 1.
Figure 3:
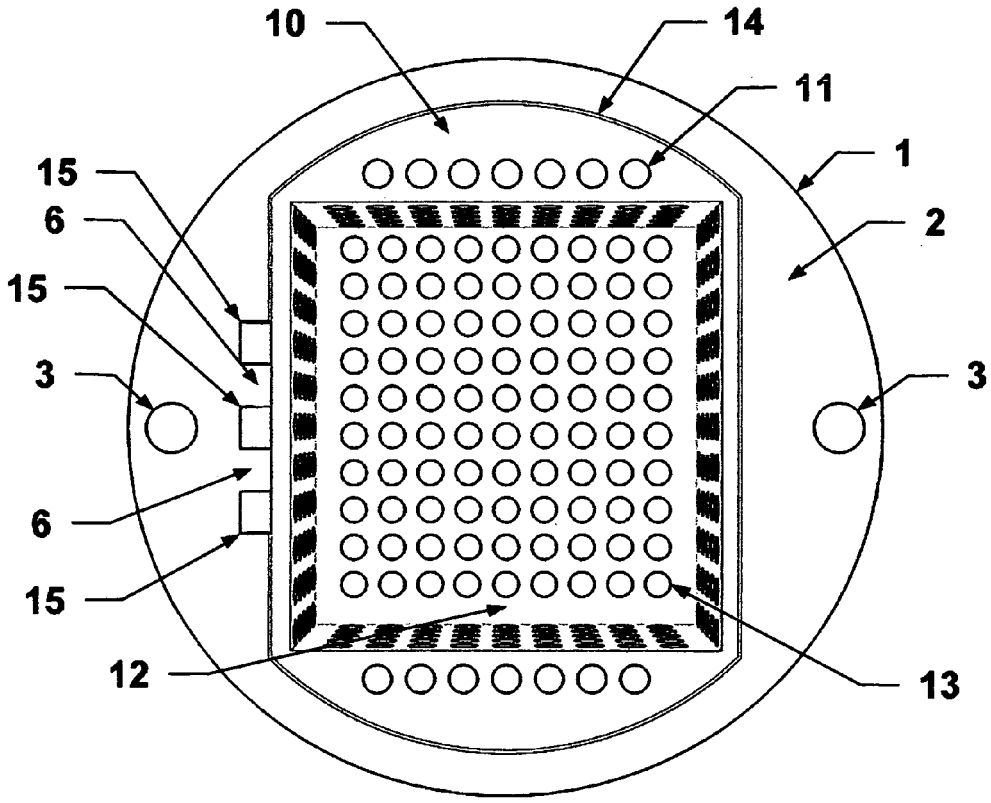
FIG. 3 is a top plan view of the drain strainer shown in FIG. 1, with the lid removed.
Figure 4:
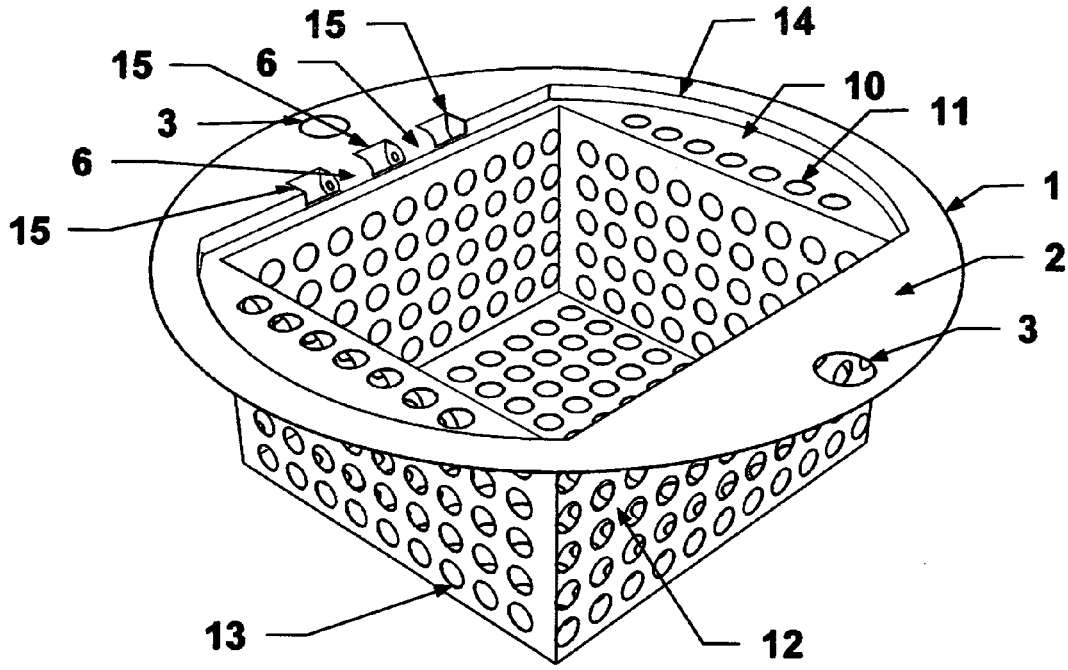
FIG. 4 is a perspective view of the drain strainer in FIG. 3.
Figure 5:
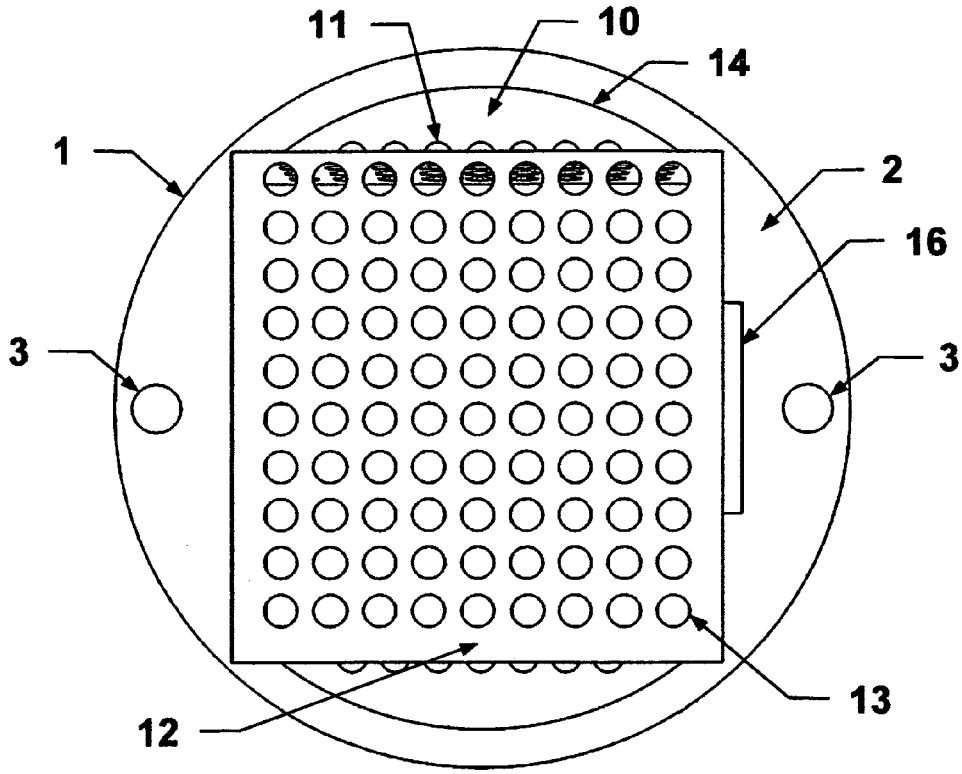
FIG. 5 is a bottom plan view of the drain strainer of FIG. 3.
Figure 6:
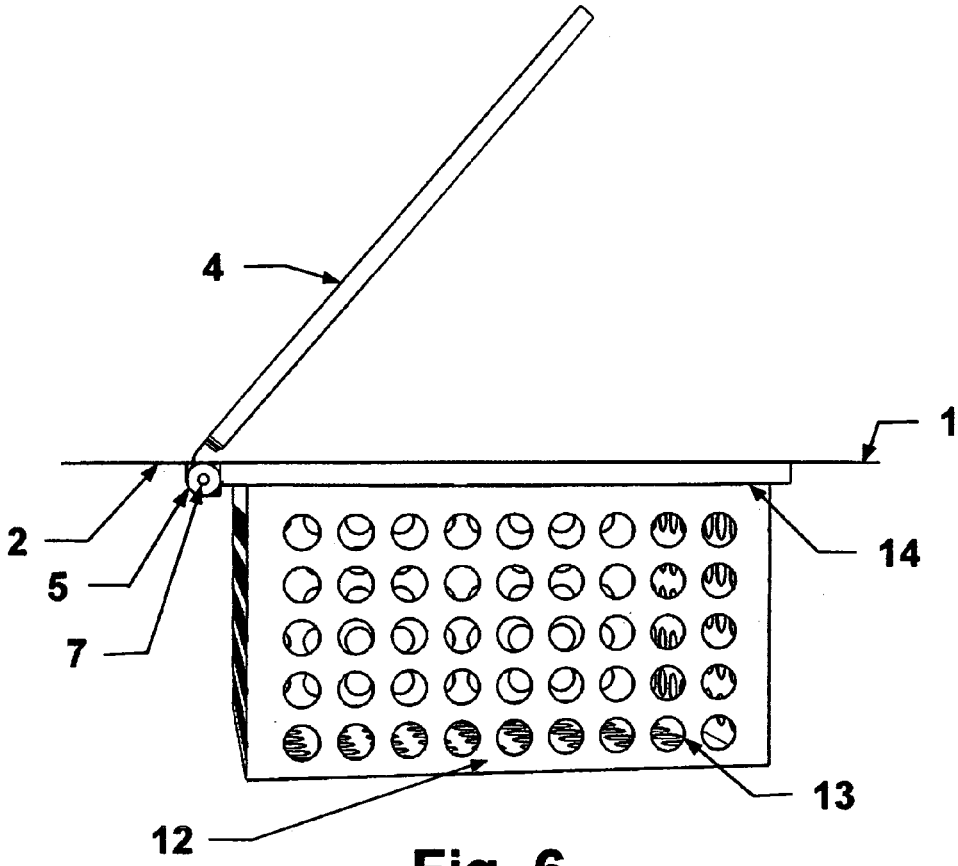
FIG. 6 is a side view of the drain strainer of FIG. 1 with the lid open.
Figure 7:
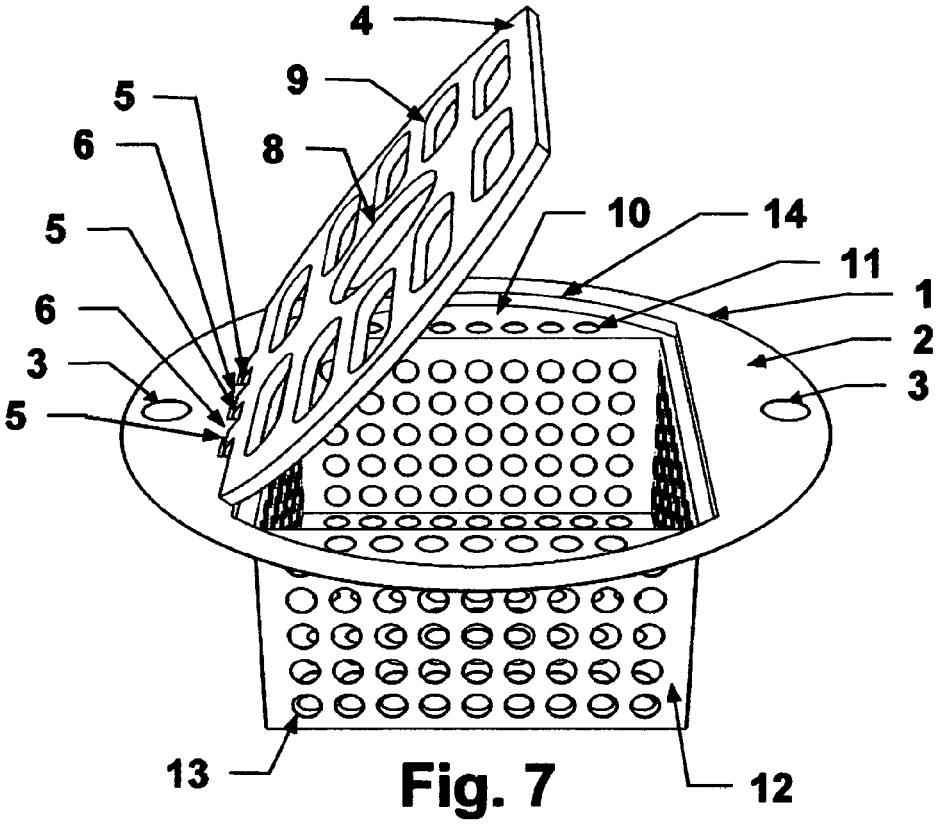
FIG. 7 is a perspective side view of the drain strainer in FIG. 6.
Figure 8:
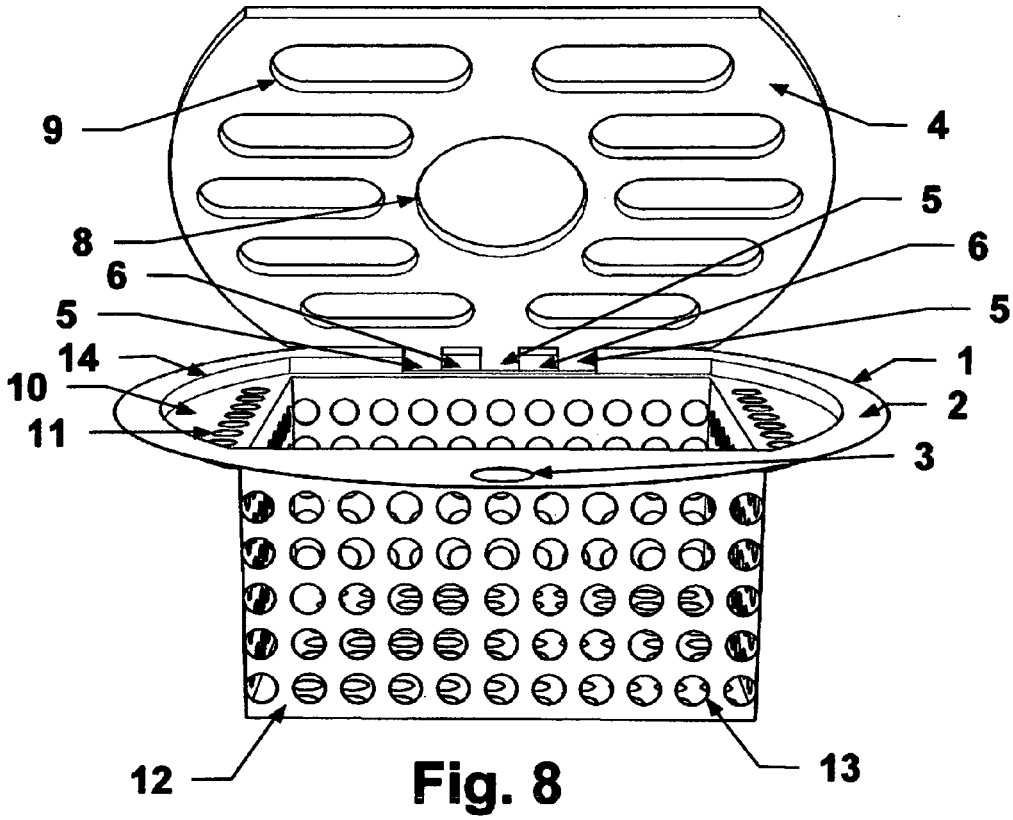
FIG. 8 is a perspective front view of the drain strainer in FIG. 6.
Figure 9:
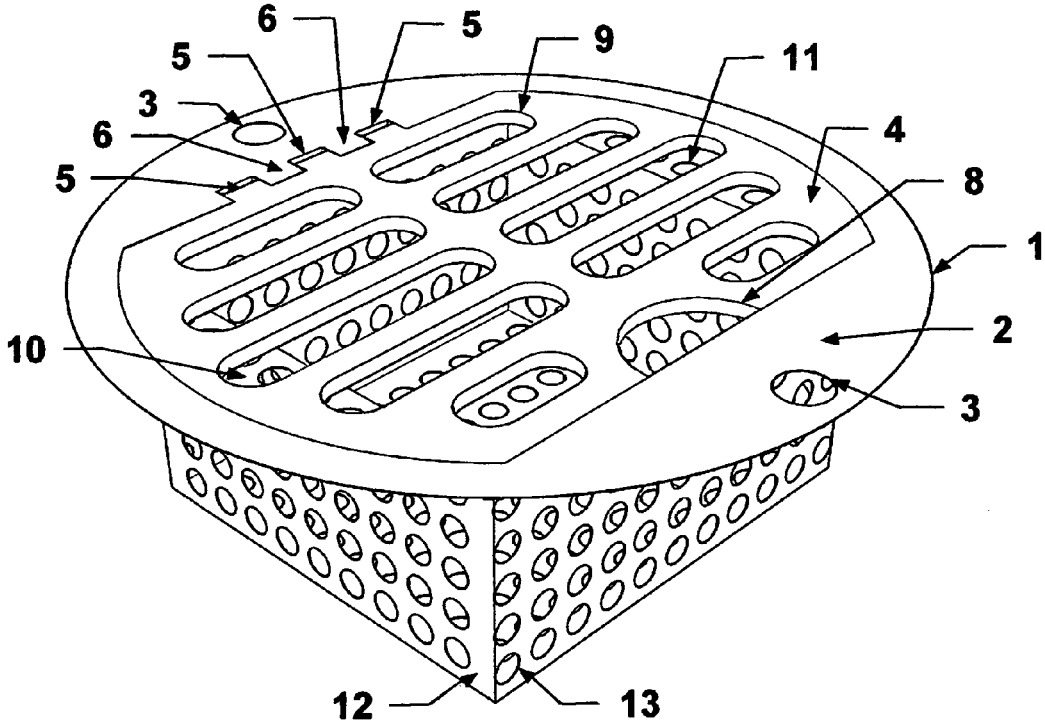
FIG. 9 is a perspective view of the drain strainer of FIG. 1, with an alternate drain plate.

The juxtaposition of outer ring 2 and basket 12 preferably forms recess 10 and shallow depression 14, shown in FIGS. 3 and 4. Recess 10 allows drain plate 4 to cover the opening of basket 12 while remaining substantially flush with the surface of outer ring 2, as shown in FIGS. 2 and 9. Holes 11 in recess 10 allow for drainage of water but not hair or other particulate matter which should collect in basket 12. In addition, recess 10 has hinge depressions 6 that receive hinge projections 5, and are coupled to one another using pin 7, shown in FIG. 6. Since the hinge is recessed into the surface 15 of outer ring 2, the hinge does not project from the top surface of the drain strainer and accidentally catch the foot of a user in the shower. Depression 16 made in outer ring 2 extends below into the user's drain to accommodate for the hinge, shown in FIG. 5.

Drain plate 4 has openings 9 and finger hole 8 that allow most particulate matter to fall into the basket. Preferably, all of the holes made in drain plate 4 are larger than any of the holes in the basket, to ensure that particulate matter does not get stuck above the drain plate to sully the feet of a showering user. Finger hole 8 is circular in shape, but could be formed in the shape of a square or a half-circle depending on need. An alternative drain plate 4 is shown in FIG. 9, with a different configuration of linear holes and finger holes to allow for better leverage when a user pulls the drain plate up to access the basket underneath.

Basket 12 has a plurality of regularly spaced holes 13, which are smaller than the holes of drain plate 4. The "area" of the holes in basket 12 is greater than the "area" of holes 8 and 9 in drain plate 4. As used herein, the "area" of a hole is the surface area of the upper side of an object that would perfectly fit in one of the holes to plug it up. Since holes 13 are so much smaller than holes 8 and 9, hair or other particulate matter will generally fall through holes 8 and 9, but will not enter any of holes 13, preventing the drain from being clogged by the particulate matter.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A drain strainer, comprising:

an outer ring defining an outer dimension and an outer opening, and further including a ledge disposed about the outer opening and recessed beneath the plane of the outer ring, the ledge further defining an inner opening and including a plurality of recess drain holes;

a basket with a plurality of basket drain holes and an upper opening, wherein the edge of the upper opening of the basket is coupled to the edge of the inner opening of the ledge;

a hinge directly coupled to one of either the basket or the outer ring;

a drain plate directly coupled to the hinge and dimensioned to cover the upper opening of the basket and fit within and cover the recessed ledge of the outer ring when the hinge is in a closed position, wherein the drain plate has at least one drain plate drain hole that overlaps at least one of the plurality of recess drain holes; and wherein the drain strainer is dimensioned to fit directly within and interconnect to a user's existing drain.

2. The drain strainer of claim 1, wherein the at least one drain plate drain hole is larger than each of the plurality of basket drain holes.

3. The drain strainer of claim 1, wherein the drain plate has a plurality of drain plate drain holes, each of which is larger than each of the plurality of basket drain holes.

4. The drain strainer of claim 1, wherein the basket has a volume of liquid throughput that is at least as great as a volume of liquid throughput of the drain plate.

5. The drain strainer of claim 1, wherein at least two screw holes are disposed on the outer ring.

6. The drain strainer of claim 1, wherein the hinge is attached to the outer ring.

7. The drain strainer of claim 1, wherein the outer ring is coupled to the basket using a permanent adhesive.

8. The drain strainer of claim 1, wherein the outer ring and the basket are molded into a single unit.

9. The drain strainer of claim 1, wherein the drain hole has a width of at least one centimeter.

10. The drain strainer of claim 1, wherein each of the basket, hinge, and drain plate comprises a corrosion resistant material.

11. The drain strainer of claim 1, wherein each of the basket, hinge, and drain plate comprises a material selected from the group consisting of stainless steel, aluminum, and durable plastic.

12. The drain strainer of claim 1, wherein the basket comprises a substantially rectangular base.

13. The drain strainer of claim 1, wherein the basket is comprised of a mesh screen.

14. A drain strainer, comprising:

an outer ring defining an outer dimension and an outer opening, and further including a ledge disposed about the outer opening and recessed beneath the plane of the outer ring, the ledge further defining an inner opening and including a plurality of recess drain holes;

a basket with a plurality of basket drain holes and an upper opening, wherein the edge of the upper opening of the basket is coupled to the edge of the inner opening of the ledge;

a drain plate removably coupled directly to the upper opening of the basket and dimensioned to cover the upper opening of the basket and fit within and cover the recessed ledge of the outer ring when the hinge is in a closed position, wherein the drain plate has a plurality of drain plate drain holes, wherein at least one of the drain plate drain holes overlaps that at least one of the plurality of recess drain holes; and wherein the drain strainer is dimensioned to fit directly within a user's existing drain.

* * * * *